US007018252B2

(12) United States Patent
Simard et al.

(10) Patent No.: US 7,018,252 B2
(45) Date of Patent: Mar. 28, 2006

(54) WATERCRAFT CONTROL MECHANISM

(75) Inventors: Richard Simard, St-Charles-de-Drummond (CA); Normand Beauregard, Valcourt (CA); Yves Berthiaume, Mont St-Hilaire (CA); Robert Bourret, Palm Bay, FL (US); Jean Daunais, Granby (CA); Daniel Nadeau, St-Denis-de-Brompton (CA); Martin Pelletier, Granby (CA); Gilles Pesant, Palm Bay, FL (US); Sam Spade, Palm Bay, FL (US); Martin Talbot, Rock Forest (CA)

(73) Assignee: Bombardier Recreational Products Inc., Valcourt (CA)

( * ) Notice: Subject to any disclaimer, the term of this patent is extended or adjusted under 35 U.S.C. 154(b) by 0 days.

(21) Appl. No.: 10/233,659

(22) Filed: Sep. 4, 2002

(65) Prior Publication Data

US 2003/0127035 A1 Jul. 10, 2003

Related U.S. Application Data

(60) Provisional application No. 60/316,269, filed on Sep. 4, 2001.

(51) Int. Cl.
*B63H 11/117* (2006.01)

(52) U.S. Cl. ..... 440/43; 114/162

(58) Field of Classification Search ..... 114/145 R, 114/145 A, 146, 162, 164, 165, 167; 440/40–43
See application file for complete search history.

(56) References Cited

U.S. PATENT DOCUMENTS

| | | | | |
|---|---|---|---|---|
| 2,522,653 | A * | 9/1950 | von Suttka | 114/165 |
| 2,992,623 | A * | 7/1961 | Heckel, Jr. | 114/165 |
| 3,038,433 | A * | 6/1962 | De Long | 114/165 |
| 3,272,171 | A | 9/1966 | Korcak | |
| 3,478,712 | A * | 11/1969 | Fox | 440/41 |
| 3,730,127 | A * | 5/1973 | Pedersen | 114/145 A |
| 3,902,441 | A * | 9/1975 | Scholle | 114/39.21 |
| 4,323,027 | A | 4/1982 | Schermerhorn | |
| 4,352,666 | A | 10/1982 | McGowan | |
| 4,615,290 | A | 10/1986 | Hall | |
| 4,632,049 | A | 12/1986 | Hall et al. | |
| 4,749,926 | A | 6/1988 | Ontolchik | |
| 4,759,732 | A | 7/1988 | Atsumi | |
| 4,854,259 | A | 8/1989 | Cluett | |

(Continued)

*Primary Examiner*—Andrew D. Wright
(74) *Attorney, Agent, or Firm*—Osler, Hoskin & Harcourt LLP

(57) ABSTRACT

A watercraft includes a watercraft control mechanism that is capable of steering, decelerating, and/or trimming a watercraft without causing the stern to elevate and the bow to dive; steers or assists steering in off-power situations; steers, trims and/or decelerates a watercraft, or assists in steering, trimming, and/or decelerating a watercraft that can be stowed or retracted to minimize hydrodynamic drag at high speeds; steers, trims and/or decelerates a watercraft, or assists in steering, trimming, and/or decelerating a watercraft that does not become clogged or jammed by seaweed or flotsam or foreign objects floating in the water; and decelerates or assists in decelerating a watercraft in a smooth and stable manner when the watercraft is travelling at high speeds.

3 Claims, 21 Drawing Sheets

U.S. PATENT DOCUMENTS 4,908,766 A 3/1990 Takeuchi
4,924,791 A * 5/1990 Scholle et al. ..... 114/39.15
4,949,662 A 8/1990 Kobayashi
4,961,396 A 10/1990 Sasagawa
4,967,682 A 11/1990 O'Donnell
5,062,815 A 11/1991 Kobayashi
5,092,260 A 3/1992 Mardikian
5,154,650 A 10/1992 Nakase
5,167,547 A 12/1992 Kobayashi et al.
5,193,478 A 3/1993 Mardikian
5,263,432 A 11/1993 Davis
5,387,141 A * 2/1995 Toyohara et al. ..... 440/41
5,474,007 A 12/1995 Kobayashi
5,494,464 A 2/1996 Kobayashi et al.
5,607,332 A 3/1997 Kobayashi et al.
5,988,092 A * 11/1999 Price ..... 114/162
6,174,210 B1 1/2001 Spade et al.
6,397,772 B1 * 6/2002 Christensen ..... 114/145 A
6,561,858 B1 * 5/2003 Walkowiak ..... 440/43
2001/0018884 A1 9/2001 Maeda et al.

* cited by examiner

WATERCRAFT CONTROL MECHANISM

CROSS REFERENCE TO RELATED APPLICATIONS

This application claims priority to U.S. application Ser. No. 60/316,269, filed Sep. 4, 2001, the entire contents of which are hereby incorporated by reference. U.S. Pat. No. 6,174,210 is hereby incorporated by reference in its entirety.

BACKGROUND OF THE INVENTION

1. Field of the Invention

This present invention relates to watercraft control mechanism, and more particularly to watercraft control mechanism that provide enhanced, integrated steering, decelerating and trimming.

2. Description of Related Art

In recent years, the demands of racers and recreational users alike for greater performance and maneuverability have driven the designers of watercraft to reconsider the control mechanisms used for steering, decelerating and trimming. Various mechanisms are known for steering, decelerating and trimming watercraft and the mechanisms may used alone or in combination.

A watercraft may be steered by either turning the propulsion source, such as an outboard motor or a jet-propulsion nozzle, or by actuating control surfaces, such as a rudder or flaps or tabs, of the personal watercraft. The rudder generally defines a substantially vertical control surface and the flaps or tabs generally define either a horizontal or vertical control surface. U.S. Pat. Nos. 4,615,290 and 4,632,049 to Hall et al. and U.S. Pat. No. 4,352,666 to McGowan disclose steering mechanisms including vertical fins and rudders. U.S. Pat. No. 5,193,478 to Mardikian discloses steering mechanisms including horizontal tabs or flaps.

A watercraft may be decelerated by reversing thrust, redirecting thrust toward the bow of the watercraft, or by creating drag by introducing a control surface substantially perpendicular to the watercraft's direction of travel. Deceleration by reversing thrust is the most common technique, but the deceleration is slow due to the time lag required to stop and then reverse the propeller.

Decelerating by redirecting the thrust toward the bow is commonly done by placing a thrust-reversing bucket or reverse gate in the path of the water jet. U.S. Pat. Nos. 5,062,815, 5,474,007, 5,494,464, and 5,607,332 to Kobayashi et al. and U.S. Pat. No. 5,154,650 to Nakase disclose thrust-reversing buckets and reverse gates. Although these thrust-reversing buckets tend to direct the water jet forwards (toward the bow), they also direct the water jet downwards. The downwardly directed water jet lifts the stern of the watercraft and causes the bow to dive. The sudden diving of the bow makes the watercraft susceptible to flooding and instability and makes it difficult for the rider to remain comfortably seated and in control of the steering handle or wheel.

U.S. Pat. No. 5,092,260 to Mardikian discloses a watercraft control mechanism for a personal watercraft including a hinged, retractable flap mounted on each side of the hull and an actuator for angling the flaps into the water to slow the watercraft. The flaps pivot such that the trailing edge is lower than the leading edge, thereby creating an undesirable elevating force at the stern.

Trimming or stabilizing of watercraft is achieved by adjusting the angle of tabs mounted aft on the hull. Trim-tabs are used to alter the running attitude of the watercraft, to compensate for changes in weight distribution, and to provide the hull with a larger surface for planing. U.S. Pat. No. 4,854,259 to Cluett, U.S. Pat. No. 4,961,396 to Sasawaga, and U.S. Pat. No. 4,323,027 to Schermerhorn disclose trim-tab systems for watercraft. U.S. Pat. No. 4,749,926 to Ontolchik, U.S. Pat. No. 4,759,732 to Atsumi, U.S. Pat. No. 4,908,766 to Takeuchi, and U.S. Pat. No. 5,263,432 to Davis disclose trim-tab control systems that are actuated by electronic feedback control systems that sense the watercraft's pitch and roll, as well as wave condition, and make adjustments to the trim-tabs to stabilize the watercraft. The trim-tab control mechanisms deflect the water downward and thus elevate the stern. U.S. Pat. No. 4,967,682 to O'Donnell discloses a twin-trim-tab mechanism capable of deflecting the water under the hull either upwards or downwards to lower or elevate the stern, respectively. The twin-trim-tab mechanism is for stabilizing the watercraft and not for braking.

Steering, braking and trimming can be performed synergistically. U.S. Pat. No. 5,193,478 to Mardikian discloses an adjustable brake and control flaps for steering, braking and trimming a watercraft. The control flaps, located at the stern, in their fully declined position act as brakes for the watercraft. Differential declination of the control flaps results in trimming and steering of the watercraft. The control flaps provide steering, braking and trimming in a manner analogous to the flaps and ailerons of an aircraft. During braking, however, the downward sweep of the control flaps causes the stern of the watercraft to rise and the bow to dive, creating the potential for flooding and instability. Diving of the bow is uncomfortable for the rider and makes control of the watercraft during hard braking maneuvers more difficult.

U.S. Pat. No. 3,272,171 to Korcak discloses a control and steering device for a watercraft including a pair of vanes pivotally mounted to the hull that can be opened below the hull. The vanes are hinged at the ends closest to the stern and open toward the bow. As water is scooped by the opening vanes, the force of the water on the vanes forces the vanes to open even more. In order to prevent the vanes from being violently flung open against the underside of the watercraft, a ducting system in incorporated into the vanes to channel the scooped water through the rear of the vanes to cushion the hull from impact of the rear of the vanes. The scooping action of the vanes induces a great deal of turbulence on the underside of the watercraft, especially when braking at high speeds. The amount of water that is channeled through the ducting system is also minimal and thus braking might, in some conditions, be too harsh. The vanes and their associated attachment bases on the underside of the watercraft create drag at high speeds, even when fully retracted. The vanes are not integrated with the main steering mechanism, such as a rudder or a steerable nozzle, to provide better cornering. The vanes may also scoop up seaweed, flotsam or other objects floating in the water that may prevent the vanes from closing or clog the ducting system. Large gears must also be provided to retract and close the vanes when they are scooping water which adds weight to the rear of the watercraft and causes the rear of the watercraft to sag.

When the user stops applying the throttle, the motor speed (measured in revolutions per minute or RPMs) drops, slowing or stopping the flow of water through the nozzle of the jet propulsion unit at the rear of the watercraft and, therefore, reducing the water pressure in the nozzle. This is known as an "off-throttle" situation. Pump pressure will also be reduced if the user stops the engine by pulling the safety lanyard or pressing the engine kill switch. The same thing would occur in cases of engine failure (i.e., no fuel, ignition problems, etc.) and jet pump failure (i.e., rotor or intake jam, cavitation, etc.). These are known as "off-power" situations. For simplicity, throughout this application, the term "off-power" will also include "off-throttle" situations, since both situations have a similar effect on pump pressure.

SUMMARY OF THE INVENTION

There exists a need for a watercraft control mechanism capable of steering, decelerating, and/or trimming a watercraft without causing the stern to elevate and the bow to dive. There also exists a need for a watercraft control mechanism that allows for steering of the watercraft in off-power situations.

It is one aspect of the invention to provide a watercraft control mechanism that steers or assists steering in off-power situations.

It is another aspect of the invention to provide a watercraft control mechanism that steers, trims and/or decelerates a watercraft, or assists in steering, trimming, and/or decelerating a watercraft that can be stowed or retracted to minimize hydrodynamic drag at high speeds.

It is a further object of the invention to provide a watercraft control mechanism that steers, trims and/or decelerates a watercraft, or assists in steering, trimming, and/or decelerating a watercraft that does not become clogged or jammed by seaweed or flotsam or foreign objects floating in the water.

It is a still further object of the invention to provide a watercraft control mechanism that decelerates or assists in decelerating a watercraft in a smooth and stable manner when the watercraft is travelling at high speeds.

DETAILED DESCRIPTION OF EXEMPLARY EMBODIMENTS

Various exemplary embodiments of watercraft including watercraft control mechanisms according to the present invention will be described with reference to the drawings, wherein like reference numbers describe like features.

As used throughout the following, the use of terms such as "front", "forward", "back", "rearward", "top", and "bottom" refer to the situation when the watercraft is in the upright position travelling in a forward direction.

Figure 1:
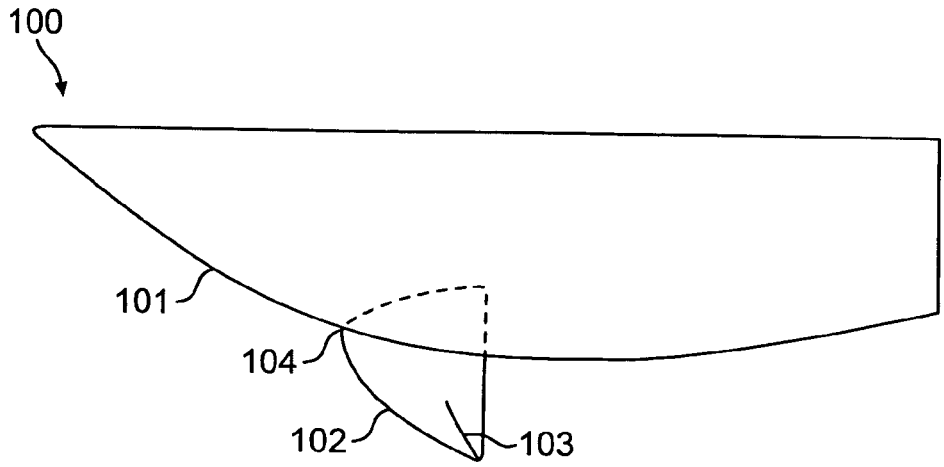
FIG. 1 is a schematic side elevation view of a watercraft including a watercraft control mechanism according to an exemplary embodiment of the invention.
Figure 2:
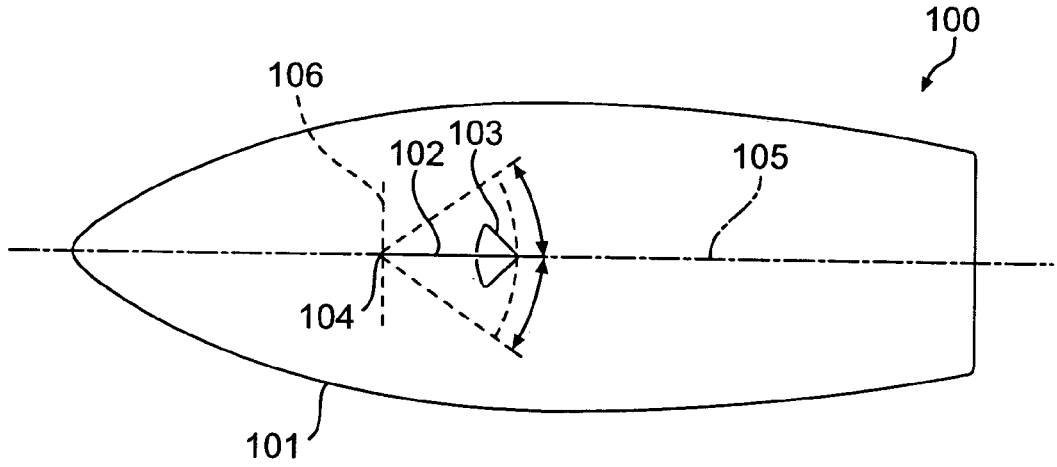
FIG. 2 is a schematic bottom view of the watercraft of FIG. 1.

Referring to FIGS. 1 and 2, a watercraft 100 includes a hull 101. A rudder 102 having an angled flap 103 is deployable under the front and in the middle of the hull 101. As shown in FIG. 2, the rudder 102 is pivotable about a point 104 to allow for steering of the watercraft 100. The rudder 102 is pivotable with respect to the longitudinal axis 105 and a transverse axis 106 of the watercraft 100. The flap 103 is attached to the rudder 102 to provide for braking and lifting of the bow of the watercraft 100.

Figure 3:
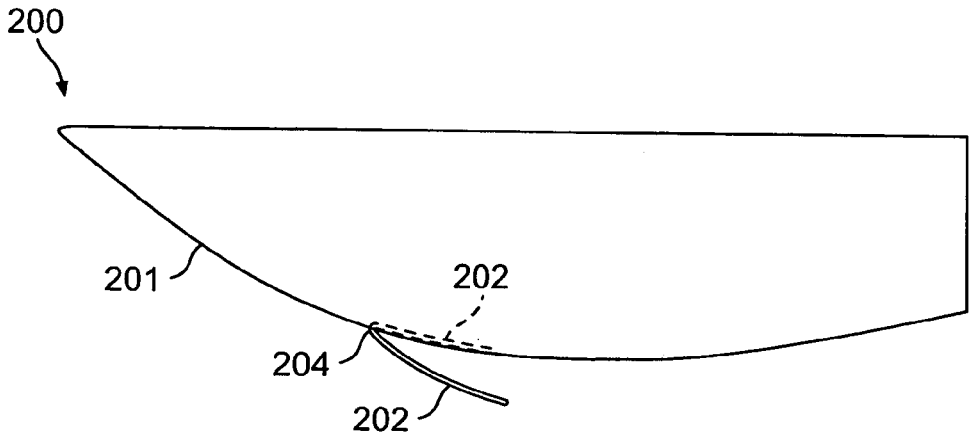
FIG. 3 is a schematic side elevation view of a watercraft including a watercraft control mechanism according to another exemplary embodiment of the invention.
Figure 4:
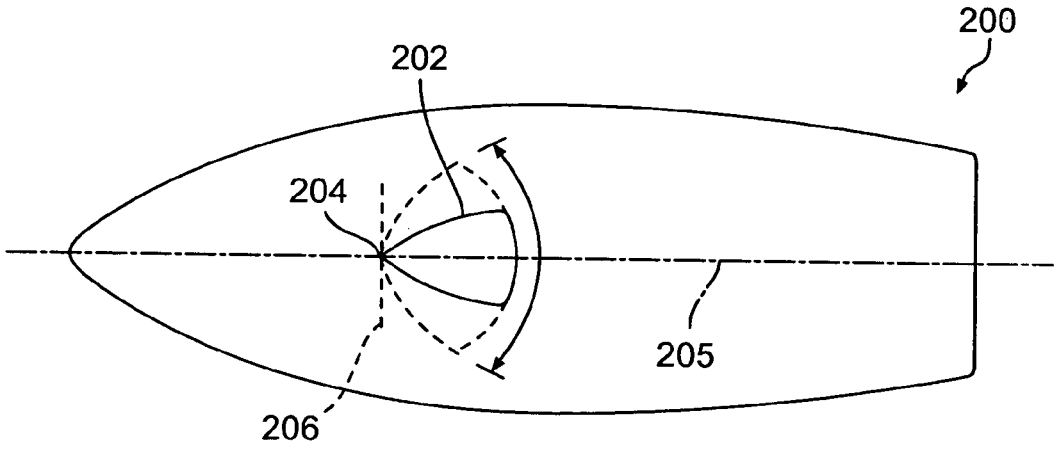
FIG. 4 is a schematic bottom view of the watercraft of FIG. 3.

Referring to FIGS. 3 and 4, a watercraft 200 includes a hull 201. A keel 202 is pivotably attached to the hull 201. The keel 202 is pivotable about a point 204 to allow or steering of the watercraft 200. The keel 202 is pivotable with respect to the longitudinal axis 205 and a transverse axis 206 of the watercraft 200. As shown in FIG. 4, the keel 202 is generally triangular in shape, although it should be appreciated that the keel 202 may be any other shape. The keel 202 is flush with the hull 201, as shown in dashed lines in FIG. 3, when not deployed.

Figure 5:
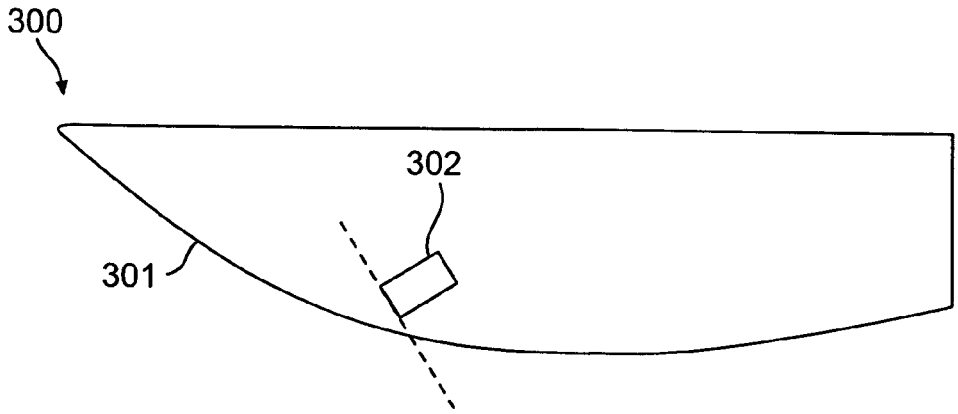
FIG. 5 is a schematic side elevation view of a watercraft including a watercraft control mechanism according to another exemplary embodiment of the invention.
Figure 6:
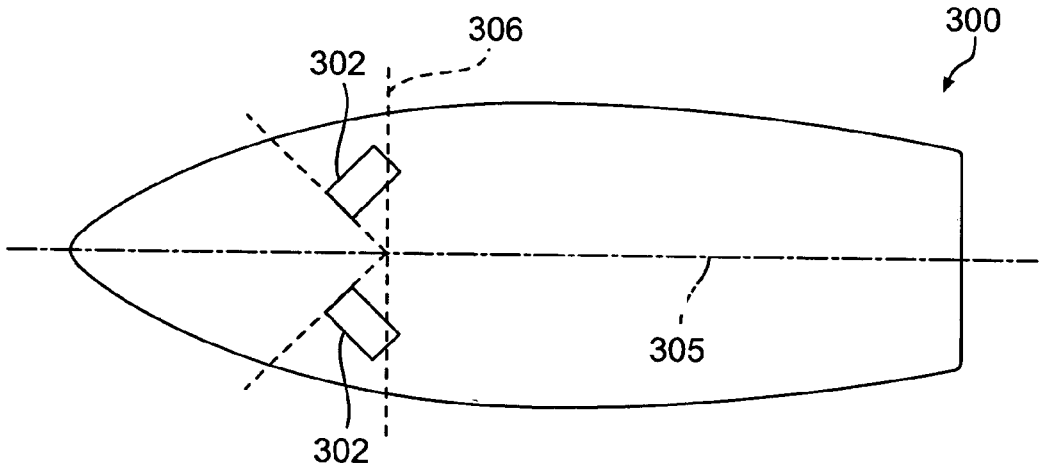
FIG. 6 is a schematic bottom view of the watercraft of FIG. 5.

Referring to FIGS. 5 and 6, a watercraft 300 includes a hull 301. Tabs 302 are attached to sides of the hull 301 towards the front of the watercraft 300 at an angle to the longitudinal axis 305 and the transverse axis 306 of the watercraft 300. The tabs 302 define a flat surface and act to scoop water when dipped in the water to allow for steering of the watercraft 300. The tabs 302 can be individually deployed to effect turning of the watercraft 300 and may be flush with the hull 301 when not deployed.

Figure 7:
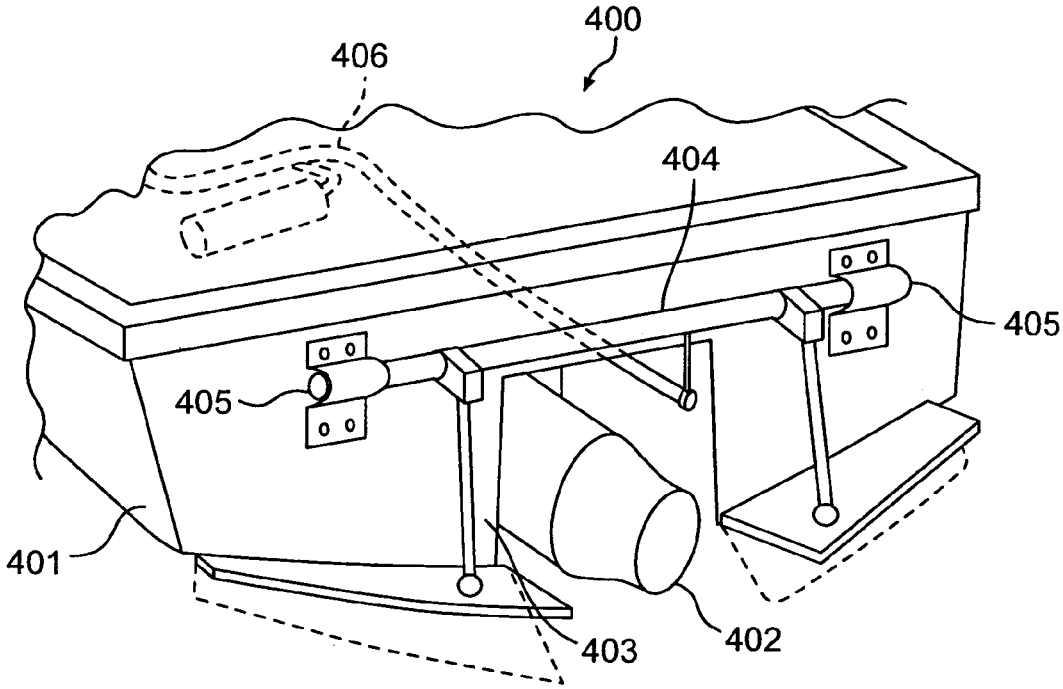
FIG. 7 is a rear partial perspective view of a watercraft including a watercraft control mechanism according to another exemplary embodiment of the invention.

Referring to FIG. 7, a watercraft 400 includes a hull 401. A nozzle 402 is pivotally attached to the hull 401 on a mounting member 403 attached to a transverse member 404 that is rotatably supported at both ends by bearings or journals 405. An actuator 406, such as a cable or rod, is attached to the mounting member 403 to pivot the mounting member 403, and thus the nozzle 402, to direct the water jet upward or downward to raise or lower, respectively, the stern of the watercraft 400.

Figure 8:
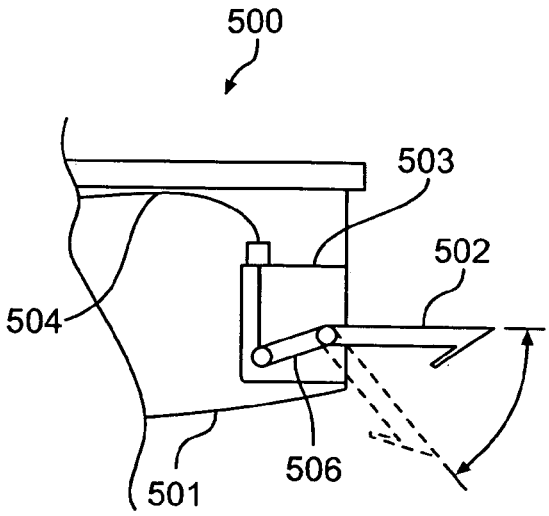
FIG. 8 is a schematic partial side elevation view of a watercraft including a watercraft control mechanism according to another exemplary embodiment of the invention.
Figure 9:
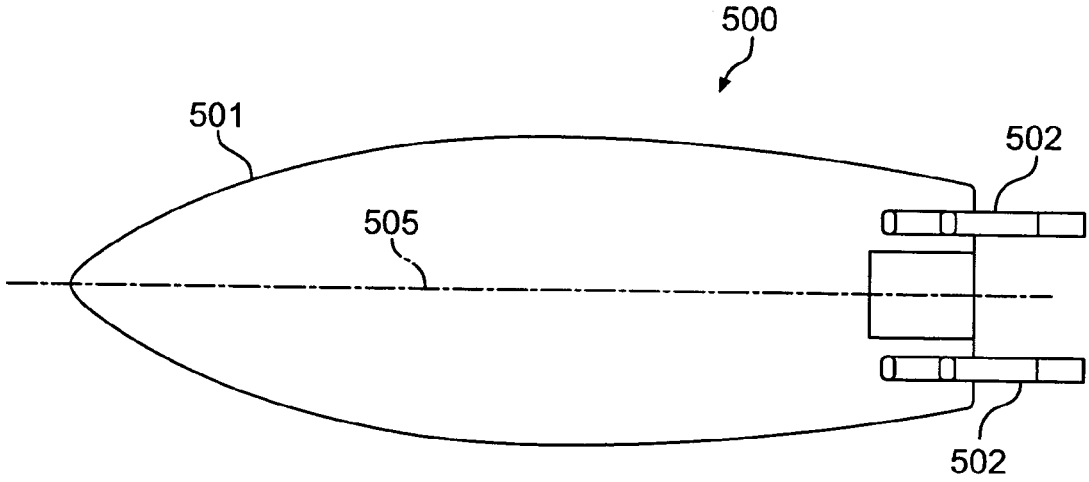
FIG. 9 is a schematic bottom view of the watercraft of FIG. 8.

Referring to FIGS. 8 and 9, a watercraft 500 includes a hull 501. Hook shaped tabs 502 are pivotably provided on opposite sides of the longitudinal axis 505 of the watercraft 500. The tabs 502 are pivotably connected to the rear of the hull 501 below the transom. The tabs 502 are pivoted by actuators 503 that each include, for example a cable 504 and an intermediate link member 506 that is pivotably attached to the a respective tab 502. It should be appreciated that other types of actuators may be used. When pivoted to the position shown in dotted lines in FIG. 8, the tabs 502 direct the water flow upward which causes the rear of the watercraft 500 to be pushed down in the water, preventing the front of the watercraft 500 from diving. The tabs 502 may be individually deployed (pivoted) or each deployed (pivoted) different amounts to affect turning of the watercraft 500. The flow of water against the hook shaped tabs 502 generates a force that tends to force or pull the rear of the hull 501 into the water.

Figure 10:
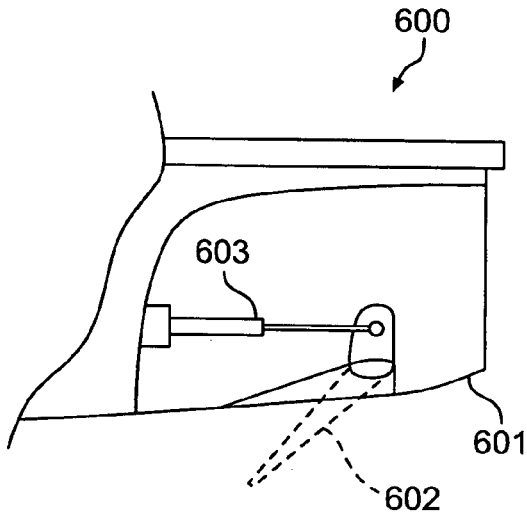
FIG. 10 is a schematic partial side elevation view of a watercraft including a watercraft control mechanism according to another exemplary embodiment of the invention.
Figure 11:
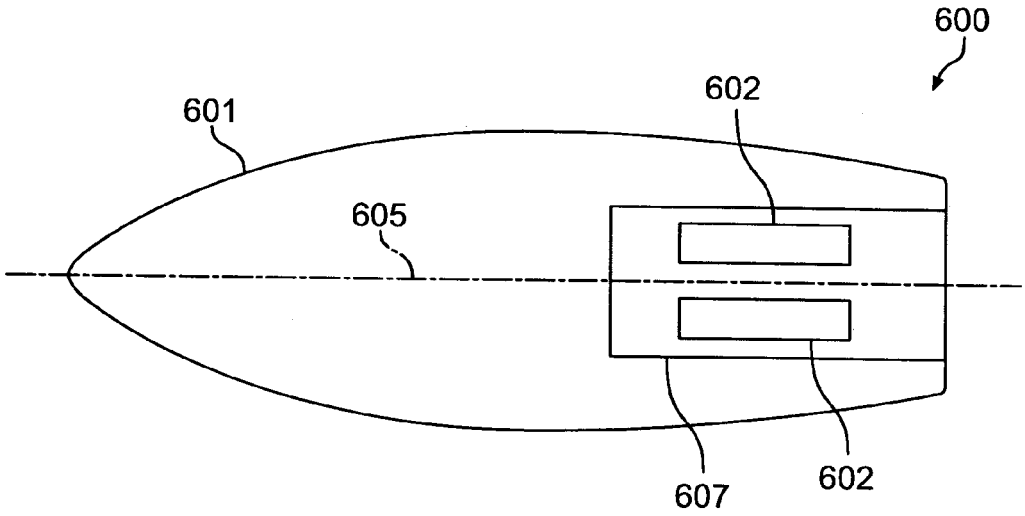
FIG. 11 is a schematic bottom view of the watercraft of FIG. 10.

Referring to FIGS. 10 and 11, a watercraft 600 includes a hull 601. Flaps 602 are pivotably attached to a ride plate 607, that is attached to the hull 601, on opposite sides of the longitudinal axis 605 of the watercraft 600. Actuators 603 pivot the flaps 602 from the closed position shown in solid line FIG. 10 to the open position shown in dotted lines in FIG. 10. When both flaps 602 are opened the water flow is directed upward and the rear of the watercraft 600 is pushed down into the water while the watercraft 600 is decelerated. The flaps 602 may also be deployed (pivoted) individually or each deployed (pivoted) different amounts to affect turning of the watercraft 600.

Figure 12:
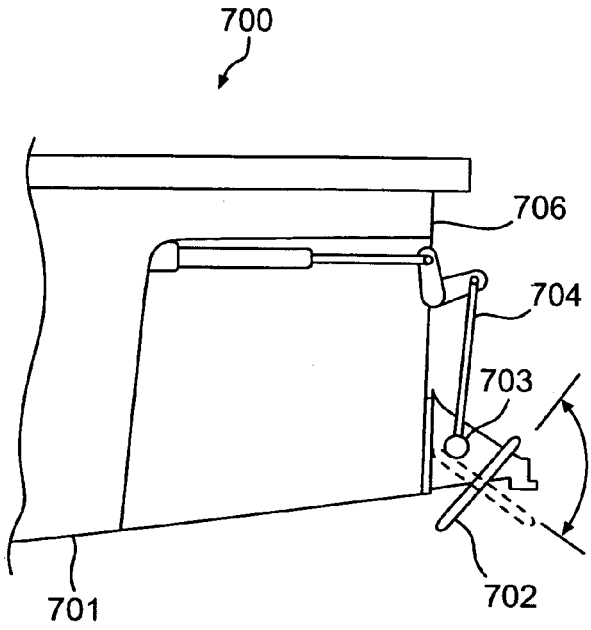
FIG. 12 is a schematic partial side elevation view of a watercraft including a watercraft control mechanism according to another exemplary embodiment of the invention.
Figure 13:
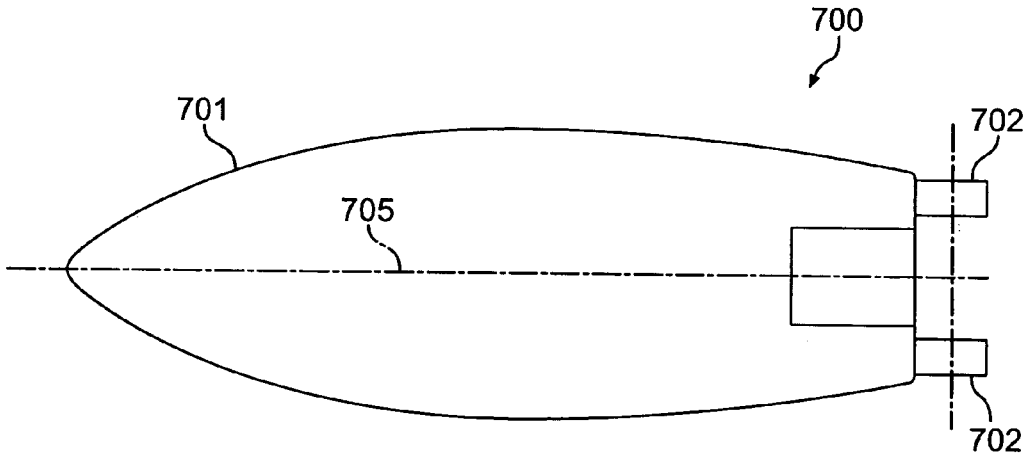
FIG. 13 is a schematic bottom view of the watercraft of the watercraft of FIG. 12.

Referring to FIGS. 12 and 13, a watercraft 700 includes a hull 701. Flaps 702 are pivotably attached to a support member(s) 703, such as a bracket(s), that is attached to the transom 706 of the watercraft 700. The flaps 702 are provided on opposite sides of the longitudinal axis 705 of the watercraft 700. Actuators 704 connected to the middle of the flaps 702 pivot the flaps 702 to direct the water flow upward, thus decelerating the watercraft 700 and pushing the rear of the watercraft 700 down.

Figure 14:
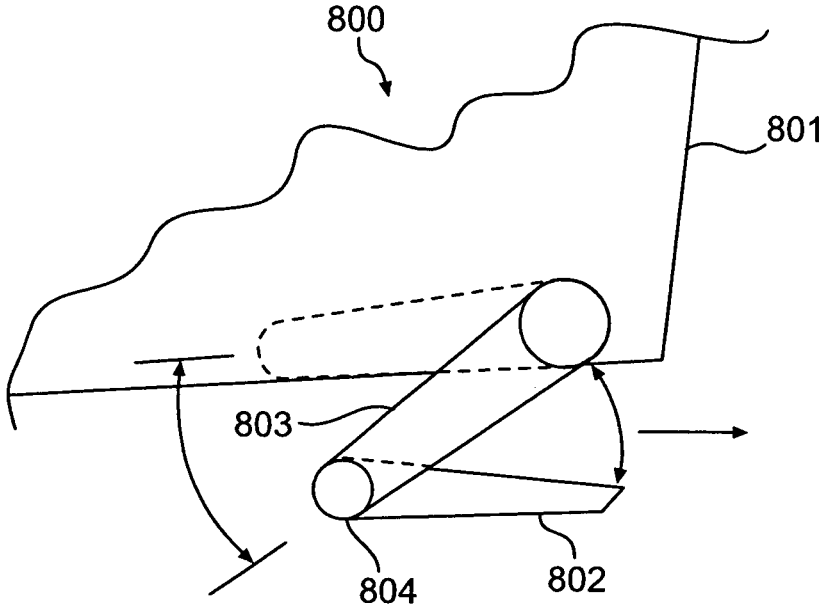
FIG. 14 is a schematic partial side elevation view of a watercraft including a watercraft control mechanism according to another exemplary embodiment of the invention.

Referring to FIG. 14, a watercraft 800 includes a hull 801. A flap 802 is pivotably connected to a tab 803 that is pivotably attached to the hull 801, or to the ride plate, and deployable into the water flow. A spring is provided at the pivotal connection 804 of the flap 802 and the tab 803. The spring loaded flap 802 provides more constant efficiency at high and low speeds.

Figure 15:
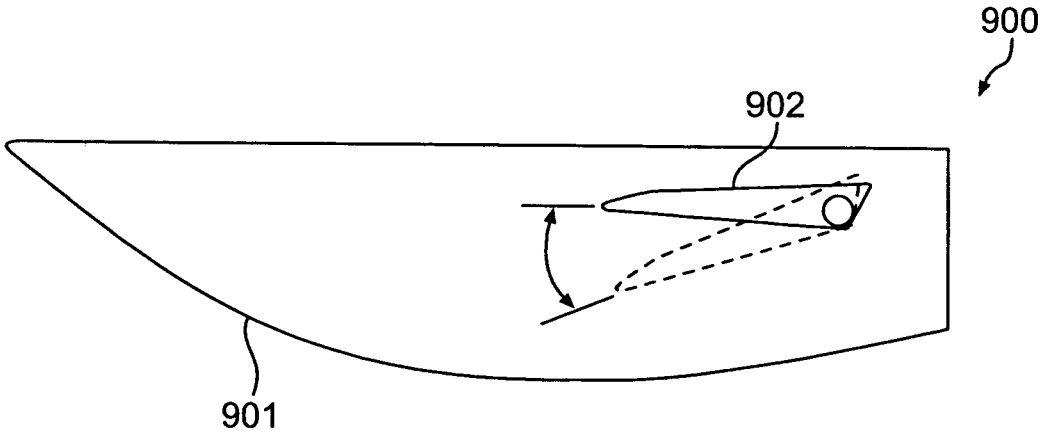
FIG. 15 is a schematic side elevation view of a watercraft including a watercraft control mechanism according to another exemplary embodiment of the invention.

Referring to FIG. 15, a watercraft 900 includes a hull 901. Sponsons 902 are pivotably attached to the hull 901 at rear portions thereof. The front portion of the sponsons 902 dip into the water when the watercraft 900 is turned.

Figure 16:
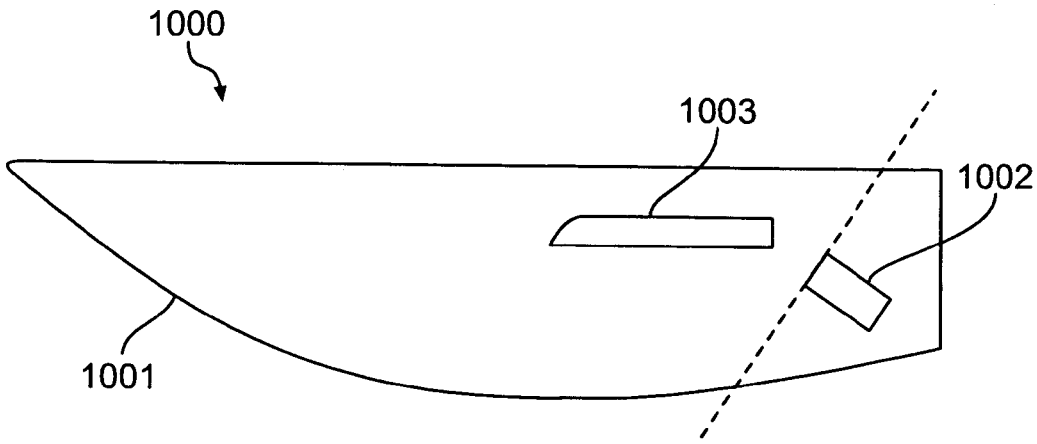
FIG. 16 is a schematic side elevation view of a watercraft including a watercraft control mechanism according to another exemplary embodiment of the invention.
Figure 17:
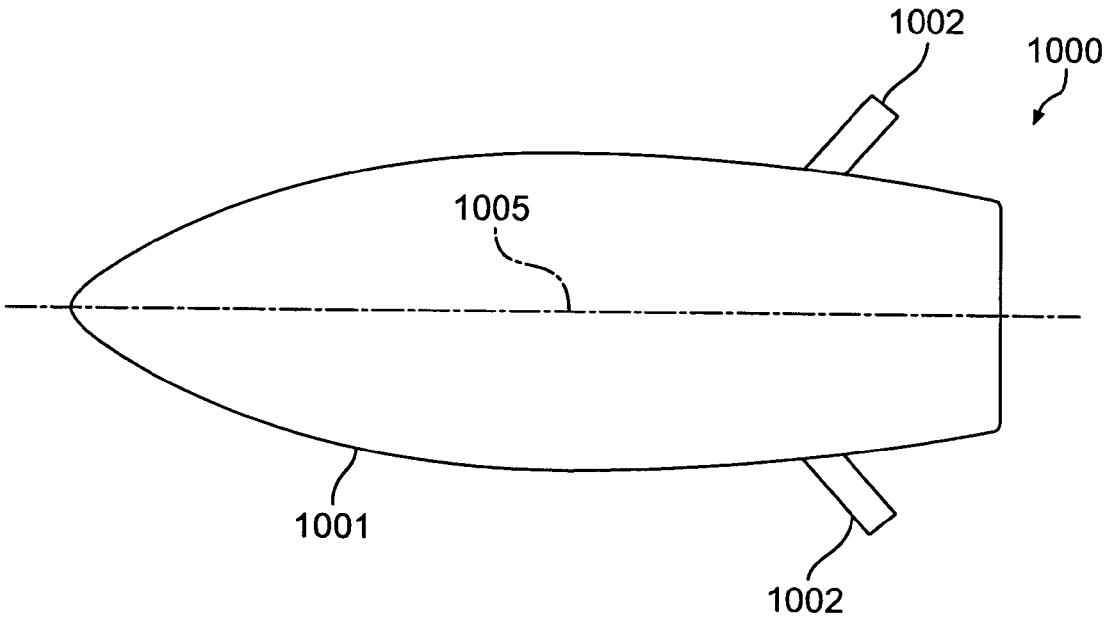
FIG. 17 is a schematic bottom view of the watercraft of FIG. 16.

Referring to FIGS. 16 and 17, a watercraft 1000 includes a hull 1001. Flaps 1002 are pivotably attached to the hull 1001 rearward of the sponsons 1003 and on opposite sides of the longitudinal axis 1005. Each flap 1002 is disposed at an angle so that when deployed, the flap 1002 causes the watercraft 1000 to turn and also pulls the side of the watercraft 1000 into the water. The flaps 1002 are flush with the hull 1001 when not deployed.

Figure 18:
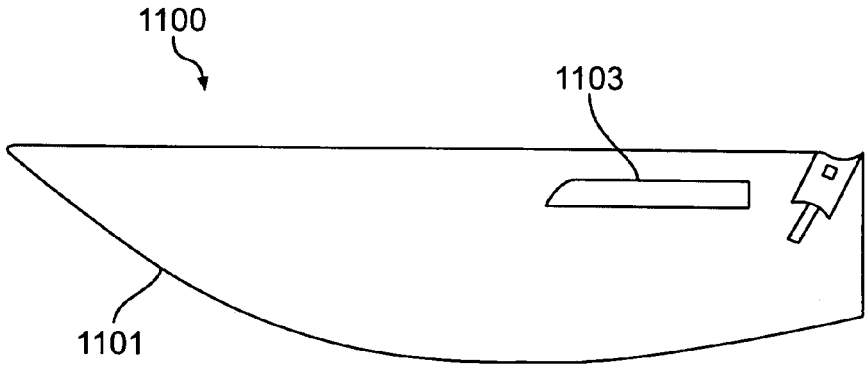
FIG. 18 is a schematic side elevation view of a watercraft including a watercraft control mechanism according to another exemplary embodiment of the invention.
Figure 19:
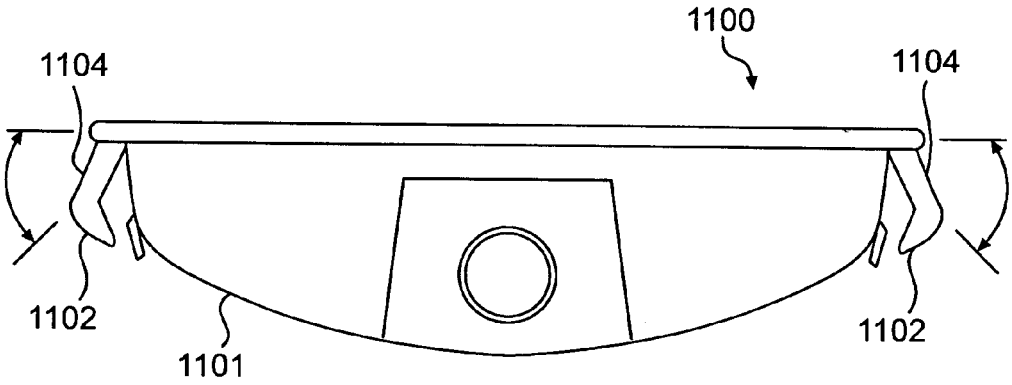
FIG. 19 is a schematic rear view of the watercraft of FIG. 18.

FIGS. 18 and 19 illustrate a modification of the watercraft of FIGS. 16 and 17. The watercraft 1100 includes a hull 1101 having sponsons 1103 on opposite sides of the hull 1101. The watercraft 1100 also includes flaps 1102 on opposite sides of the hull 1101. The flap support and actuation mechanisms 1104 are supported outside the hull 1101 and the flaps 1102 are not flush with the hull 1101 when deployed.

Figure 20:
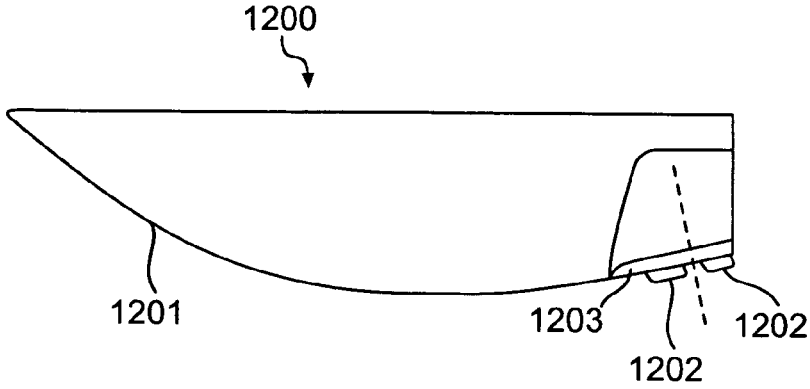
FIG. 20 is a schematic side elevation view of a watercraft including a watercraft control mechanism according to another exemplary embodiment of the invention.
Figure 21:
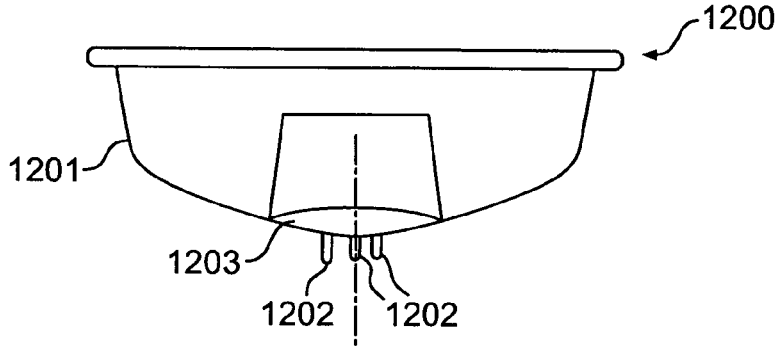
FIG. 21 is a schematic rear view of the watercraft of FIG. 20.
Figure 22:
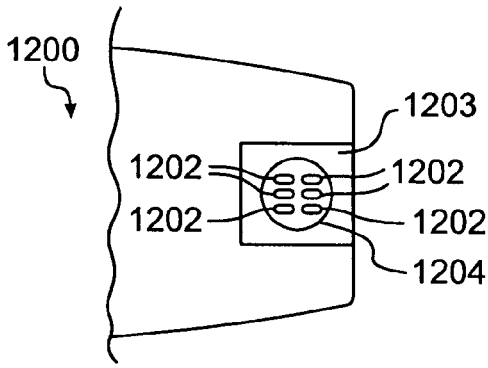
FIG. 22 is a schematic partial bottom view of the watercraft of FIGS. 20 and 21.

Referring to FIGS. 20–22, a watercraft 1200 includes a hull 1201 and a ride plate 1203. Fins 1202 extend downward from the ride plate 1203. The fins 1202 are attached to a rotatable section 1204 of the ride plate 1203 to allow for steering of the watercraft 1200. It should be appreciated that the entire ride plate 1203 may be rotatable, and not just a section.

Figure 23:
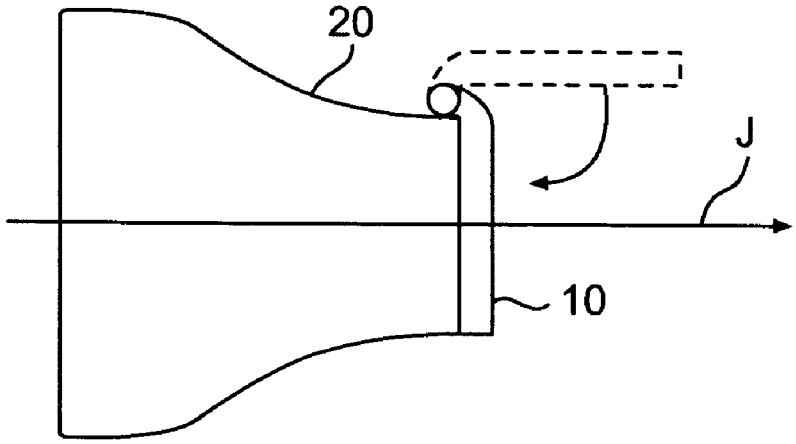
FIG. 23 is a schematic side elevation view of a watercraft control mechanism according to another exemplary embodiment of the invention.

Referring to FIG. 23, a watercraft control mechanism includes a rudder 10 pivotably attached to a nozzle 20 of a jet propulsion unit of a watercraft. The rudder 10 may be spring loaded to pivot from the position shown in dashed lines into the path of the water jet J as shown in solid lines as the pressure of the water jet decreases during deceleration of the watercraft to allow for steering of the watercraft during deceleration. Although the rudder 10 is shown pivotably attached to the top of the steerable nozzle 20, it should be appreciated that the rudder 10 may be pivotably attached to the bottom of the steerable nozzle 20.

Figure 24:
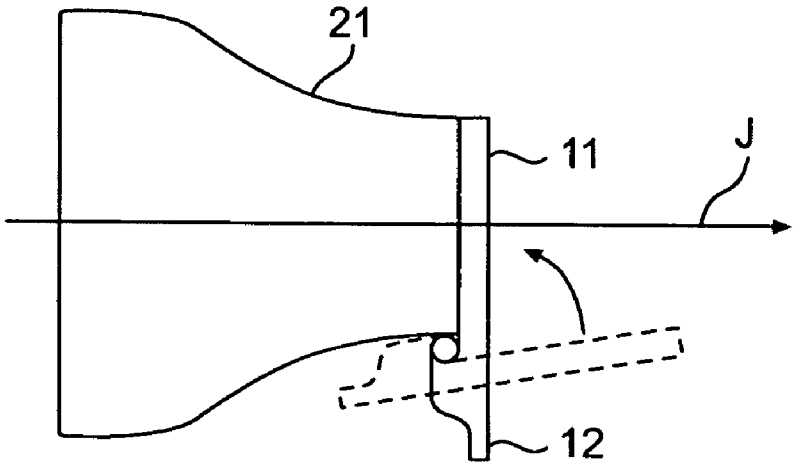
FIG. 24 is a schematic side elevation view of a watercraft control mechanism according to another exemplary embodiment of the invention.

FIG. 24 shows a modification of the watercraft control mechanism of FIG. 23. A closure 11 is pivotably attached to a nozzle of the jet propulsion unit of a watercraft. The closure 11 covers the opening of the nozzle 20 when in the position shown in solid lines. The closure 11 is spring loaded to be pivoted from the position shown in dashed lines into the water jet J during deceleration of the watercraft and includes a rudder 12 that contacts the steerable nozzle 21 to limit the pivoting movement of the closure 11. Although the closure 11 is shown attached to the bottom of the steerable nozzle 21, it should be appreciated that the closure 11 may be pivotably attached to the top of the steerable nozzle 20.

Figure 25:
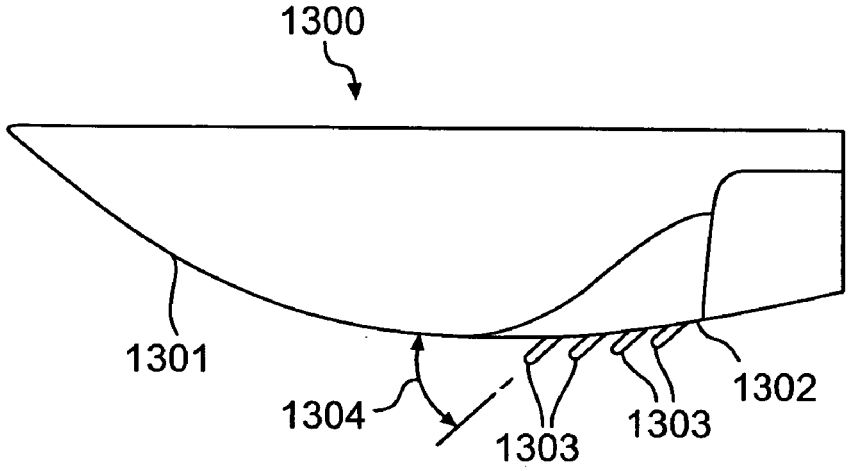
FIG. 25 is a schematic side elevation view of a watercraft including a watercraft control mechanism according to another exemplary embodiment of the invention.

Referring to FIG. 25, a watercraft 1300 includes a hull 1301 and an inlet grill 1302 on the bottom of the hull 1301 that prevents seaweed and flotsam from entering the water jet propulsion unit of the watercraft 1300. Deployable tabs 1303 are provided on the inlet grill 1302 and are pivotable through an angle 1304 to provide deceleration of the watercraft 1300.

Figure 26:
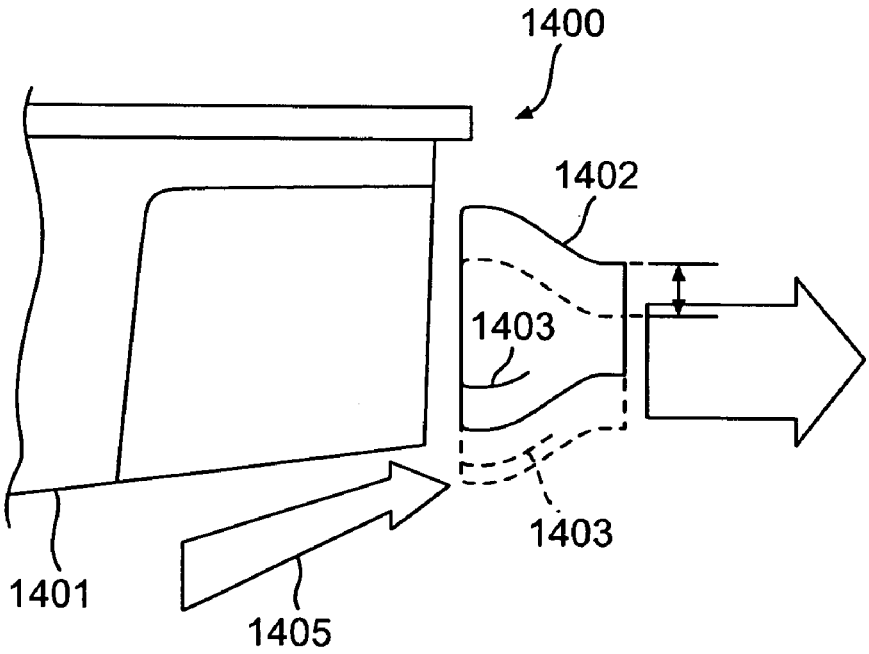
FIG. 26 is a schematic partial side elevation view of a watercraft including a watercraft control mechanism according to another exemplary embodiment of the invention.

Referring to FIG. 26, a watercraft 1400 includes a hull 1401 and a steerable nozzle 1402. The steerable nozzle 1402 is movable up and down as shown in dashed lines and includes a conduit 1403 in a bottom portion that catches water as the steerable nozzle 1402 is moved down. Water flow 1405 bypasses the impeller and flows into the conduit 1403 to provide steering of the watercraft 1400 as the steerable nozzle 1402 is turned.

Figure 27:
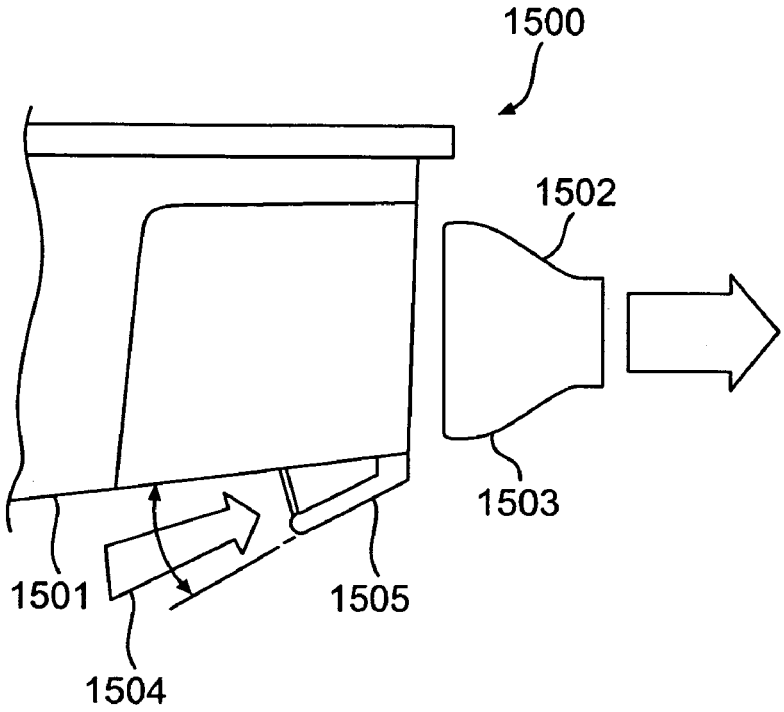
FIG. 27 is a schematic partial side elevation view of a watercraft including a watercraft control mechanism according to another exemplary embodiment of the invention.

FIG. 27 shows a modification of the watercraft and watercraft control mechanism of FIG. 26. A watercraft 1500 includes a hull 1501 and a steerable nozzle 1502. The steerable nozzle 1502 includes a bottom conduit 1503 through which the water flow 1504 can bypass the impeller of the water jet propulsion unit. A deployable tab 1505 is attached to the hull 1501 to direct the water flow 1504 into the bottom conduit 1503.

Figure 28:
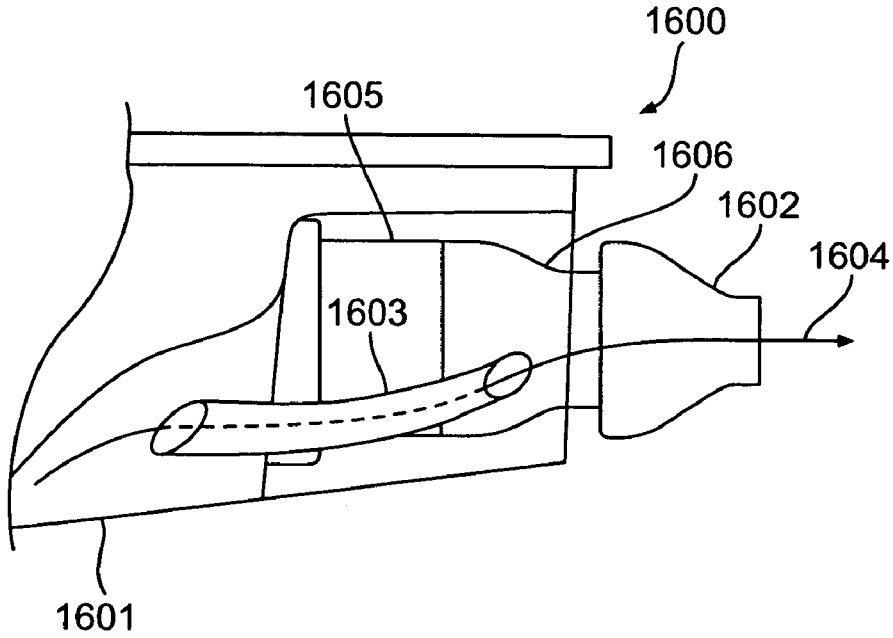
FIG. 28 is a schematic partial side elevation view of a watercraft including a watercraft control mechanism according to another exemplary embodiment of the invention.

Referring to FIG. 28, a watercraft 1600 includes a hull 1601 and a water jet propulsion unit 1605 including a venturi 1606 and a steerable nozzle 1602. A pump bypass conduit 1603 is provided to allow the waterflow 1604 to pass directly from the inlet to the venturi 1606 when needed. When stopped, the impeller of the water jet propulsion 1605 almost completely blocks the waterflow 1604 through the water jet propulsion unit 1605 and the steerable nozzle 1602. The conduit 1603 opens when the throttle is released and the impeller is stopped to permit the waterflow 1604 to flow into the steerable nozzle 1602 to allow steering of the watercraft 1600.

Figure 29:
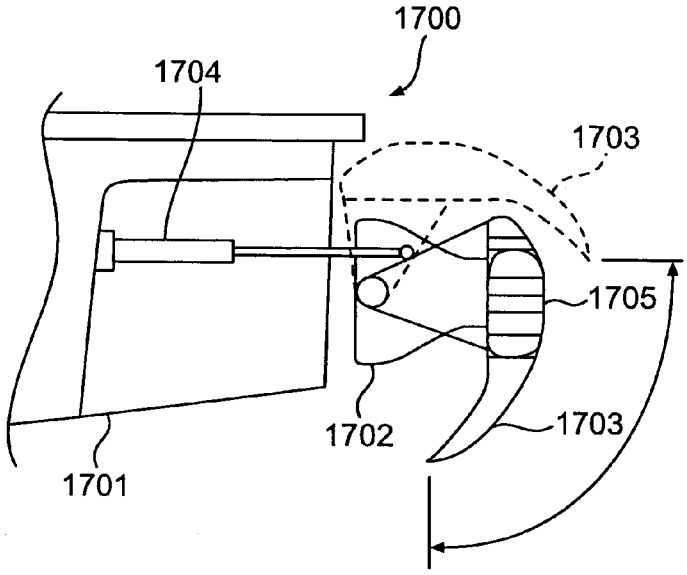
FIG. 29 is a schematic partial side elevation view of a watercraft including a watercraft control mechanism according to another exemplary embodiment of the invention.

Referring to FIG. 29, a watercraft 1700 includes a hull 1701 and a steerable nozzle 1702 of a water jet propulsion unit. A reverse gate 1705 is pivotably attached to the steerable nozzle 1702 and an actuator 1704 is operatively connected to the gate 1705 to pivot the gate 1705 from the position in dashed lines to the position in solid lines. In the position shown in solid lines, the gate 1705 acts to brake the watercraft 1700. A rudder 1703 is attached to the gate 1705.

Figure 30:
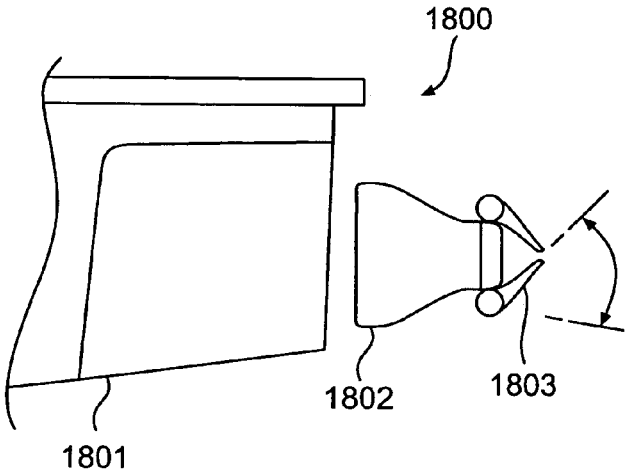
FIG. 30 is a schematic partial side elevation view of a watercraft including a watercraft control mechanism according to another exemplary embodiment of the invention.
Figure 31:
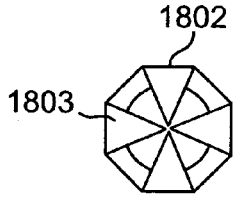
FIG. 31 is a schematic partial rear view of the watercraft control mechanism of FIG. 30.

Referring to FIGS. 30 and 31, a watercraft 1800 includes a hull 1801 and a steerable nozzle 1802 of a water jet propulsion unit. A gate including a plurality of panels 1803 pivotably attached to the steerable nozzle 1802. The panels 1803 are pivotable into the water jet to allow for deceleration of the watercraft 1800. Although eight panels 1803 are shown, it should be appreciated that any number of panels may be provided.

Figure 32:
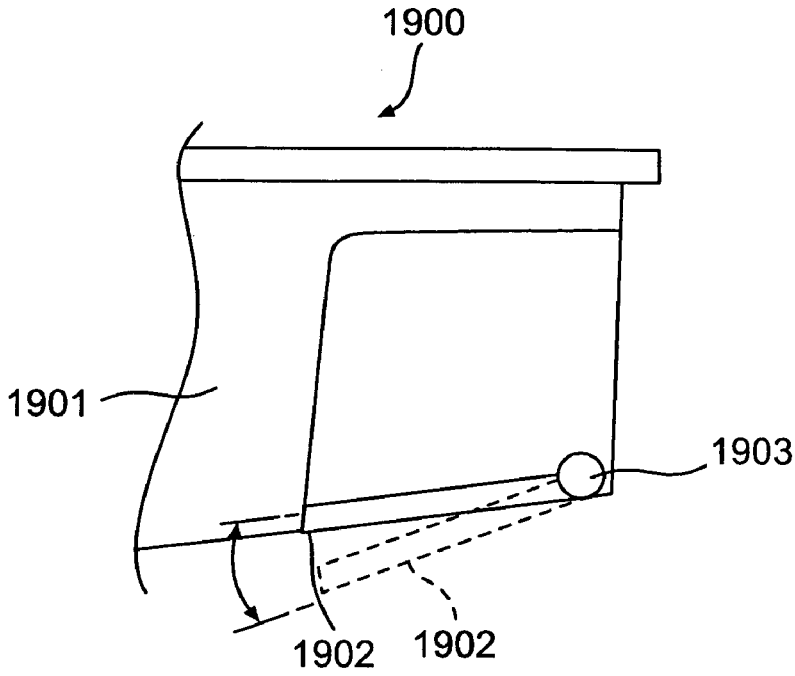
FIG. 32 is a schematic partial side elevation view of a watercraft including a watercraft control mechanism according to another exemplary embodiment of the invention.

Referring to FIG. 32, a watercraft 1900 includes a hull 1901 and a ride plate 1902 pivotably attached to the hull 1901 at a rear portion 1903 of the hull. The ride plate 1902 is pivoted from the position shown in solid lines to the position shown in dashed lines to assist in braking the watercraft 1900.

Figure 33:
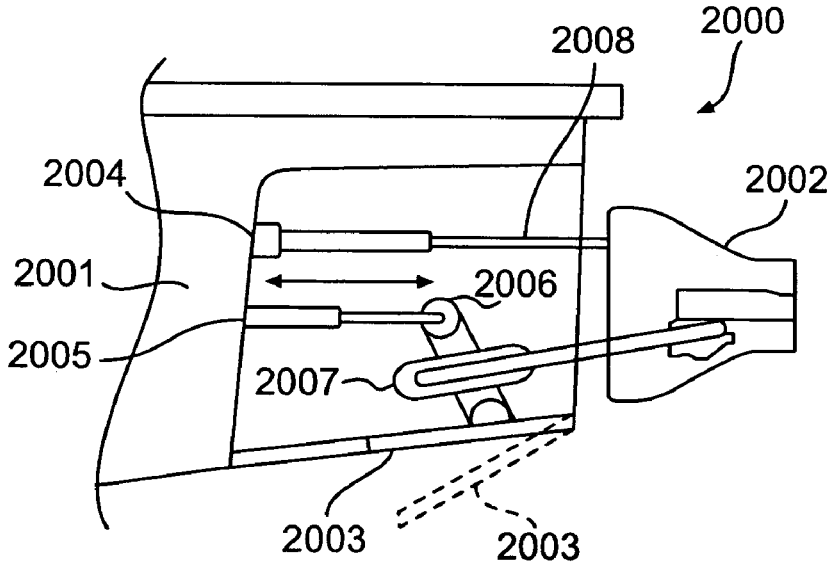
FIG. 33 is a schematic partial side elevation view of a watercraft including a watercraft control mechanism according to another exemplary embodiment of the invention.
Figure 34:
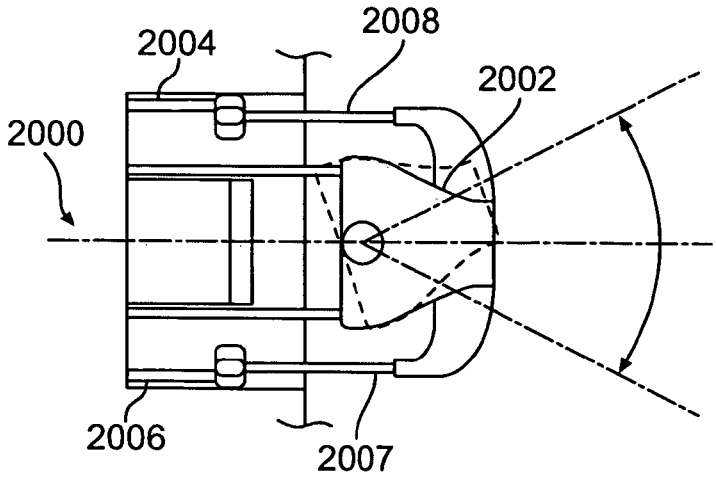
FIG. 34 is a bottom view of the watercraft of FIG. 33.

Referring to FIGS. 33 and 34, a watercraft 2000 includes a hull 2001 and a steerable nozzle 2002 of a water jet propulsion unit. A pivotable flap or flaps 2003 that assist in braking the watercraft 2000 are attached to the hull 2001 or the ride plate and are connected to an actuator 2005 through link members 2006 and 2007. The steerable nozzle 2002 is connected to an actuator 2004 through a link 2008. The actuator 2005 is operatively connected to and actuated by one handle on the watercraft handle bar and the actuator 2004 is operatively connected to and actuated by the handle bar.

Figure 35:
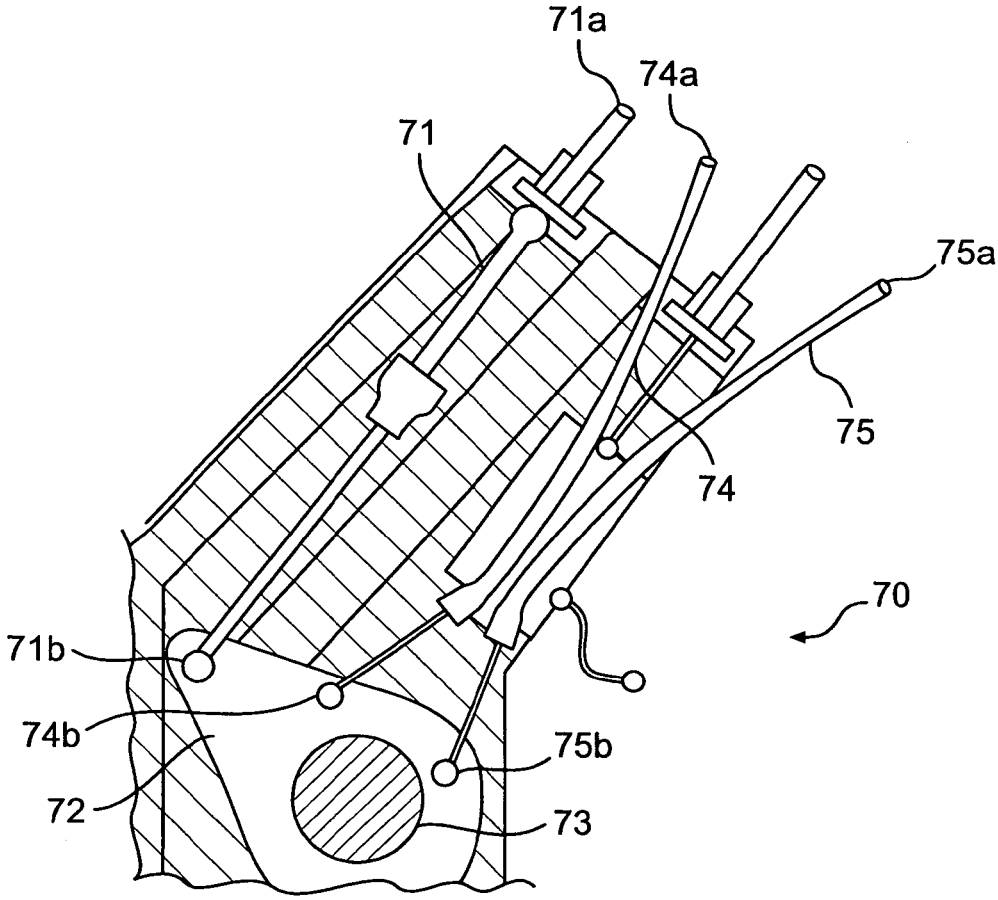
FIG. 35 is a schematic illustration of an actuator for a watercraft control mechanism according to an exemplary embodiment of the invention.

Referring to FIG. 35, a watercraft control mechanism 70 of a watercraft includes a push/pull cable 71 having a first end 71*a* connected to a steerable nozzle (not shown) of a water jet propulsion unit and a second end 71*b* connected to a member 72 fixed to a steering column 73. Cables 74 and 75 are connected to a steering mechanism (not shown), such as a rudder, independent of the steerable nozzle, at first ends 74*a* and 75*a*, respectively, and are connected to the member 72 at second ends 74*b* and 75*b*, respectivley, to provide for steering of the watercraft.

Figure 36:
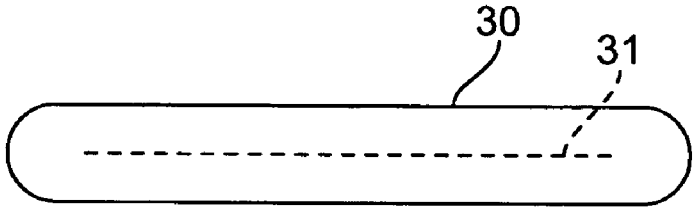
FIG. 36 is a schematic top view of a watercraft control mechanism according to another exemplary embodiment of the invention.
Figure 37:
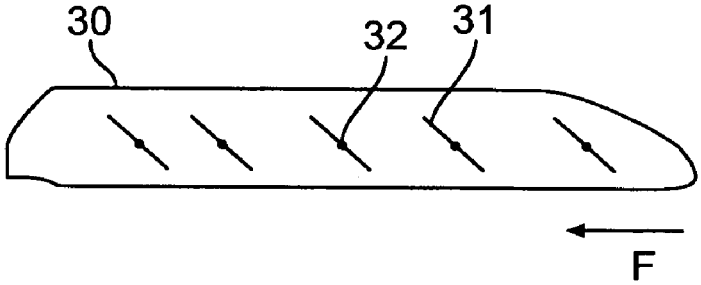
FIG. 37 is a schematic side elevation view of the watercraft control mechanism of FIG. 36.

Referring to FIGS. 36 and 37, a watercraft control mechanism includes a sponson 30 having flaps 31 disposed therein. The flaps 31 are pivotable about vertical axes 32 and are deployable (pivotable) with respect to the water flow F to assist in steering the watercraft. The watercraft control mechanism includes a sponson 30 disposed on each side of the hull of the watercraft. Although a plurality of flaps are shown, it should be appreciated that only one flap may be used.

Figure 38:
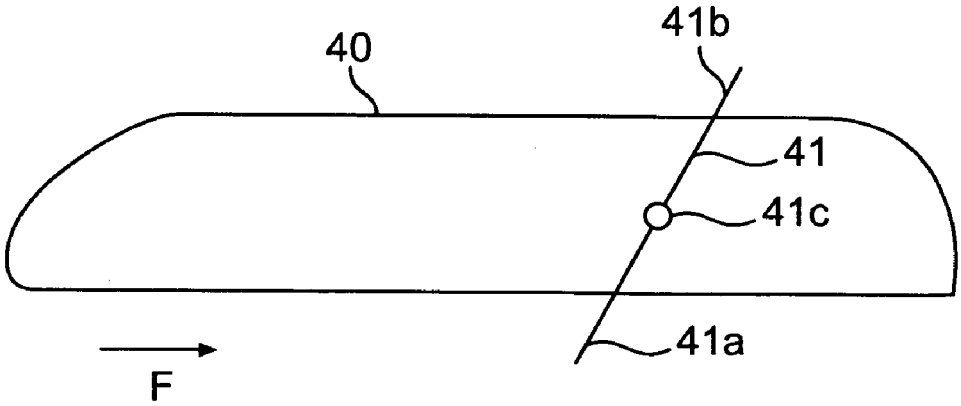
FIG. 38 is a schematic side elevation view of a watercraft control mechanism according to another exemplary embodiment of the invention.

Referring to FIG. 38, a watercraft control mechanism includes a sponson 40 having a pivotable flap 41 attached thereto. When deployed, a front portion 41*a* of the sponson dips into the water flow F and a rear portion 41*b* extends above the sponson 41. Deployment of the flap 41 assists in preventing the rear of the watercraft from elevating during deceleration of the watercraft. The watercraft control mechanism includes a sponson 40 disposed on each side of the hull of the watercraft. Although a single flap is shown, it should be appreciated that a plurality of flaps may be used. The flap 41 is pivotable about a horizontal axis 41*c*.

Figure 39:
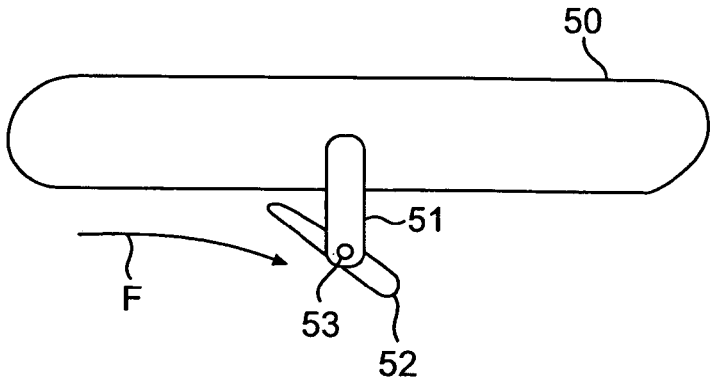
FIG. 39 is a schematic top view of a watercraft control mechanism according to another exemplary embodiment of the invention.

Referring to FIG. 39, a watercraft control mechanism includes a sponson 50 having a pivotable flap 52 supported by a support member 51. The flap 52 is deployable (pivotable) about a vertical axis 53 into the water flow F to assist in steering the watercraft. The watercraft control mechanism includes a sponson on each side of the hull of the watercraft. Although a single flap is shown, it should be appreciated that a plurality of flaps may be used.

Figure 40:
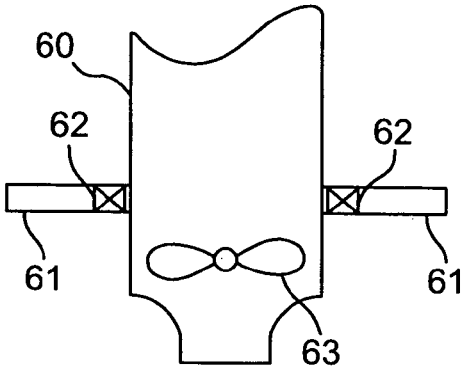
FIG. 40 is a schematic illustration of a watercraft control mechanism according to another exemplary embodiment of the invention.

Referring to FIG. 40, a watercraft control mechanism includes a venturi 60 of a water jet propulsion unit. Side thrusters 61 are provided on opposite sides of the venturi 60 before an impeller 63 of the water jet propulsion unit and valves 62 control the flow of water through the side thrusters 61. Selectively allowing water flow through a side thruster 61 by opening a valve 62 assists in steering the watercraft. The degree of opening of each valve 62 may be controlled to more finely control the steering of the watercraft. When the engine is stopped, the impeller 63 blocks the flow of water through the propulsion unit. Opening of one valve 62 while the remaining valve is closed allows water to flow through the open valve and steering of the watercraft.

Figure 41:
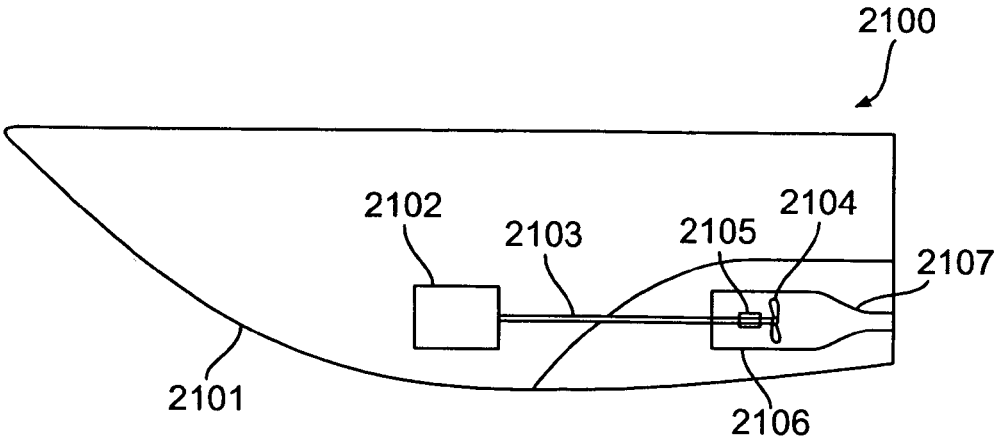
FIG. 41 is a schematic illustration of a watercraft including a watercraft control mechanism according to another exemplary embodiment of the invention.

Referring to FIG. 41, a watercraft 2100 includes a hull 2101, a motor 2102, such as an internal combustion engine, and a water jet propulsion unit 2106. A drive shaft 2103 connects the motor 2102 to the water jet propulsion unit 2106. An impeller 2104 is mounted to the drive shaft 2103 to increase the pressure of water flowing through the water jet propulsion unit 2106 and out of a venturi 2107 to propel the watercraft 2100. A ratchet mechanism 2105 is connected to the impeller 2104 and allows the impeller to counter-rotate to permit the water to flow through the nozzle when the throttle stops. A clutch mechanism may be provided in addition to or instead of the ratchet mechanism to disengage the impeller 2104 and allow the impeller 2104 to rotate freely.

Alternatively, the ratchet mechanism could be replaced by a clutch on the drive shaft 2103 that disengages when the throttle is released to permit the impeller 2104 to rotate freely and allow the water flow to the nozzle 2107. Additionally, a brake may be placed on the drive shaft 2103 that assists with decelerating the watercraft 2100, but not steering. The brake may be used in combination with either the ratchet mechanism or the clutch.

Figure 42:
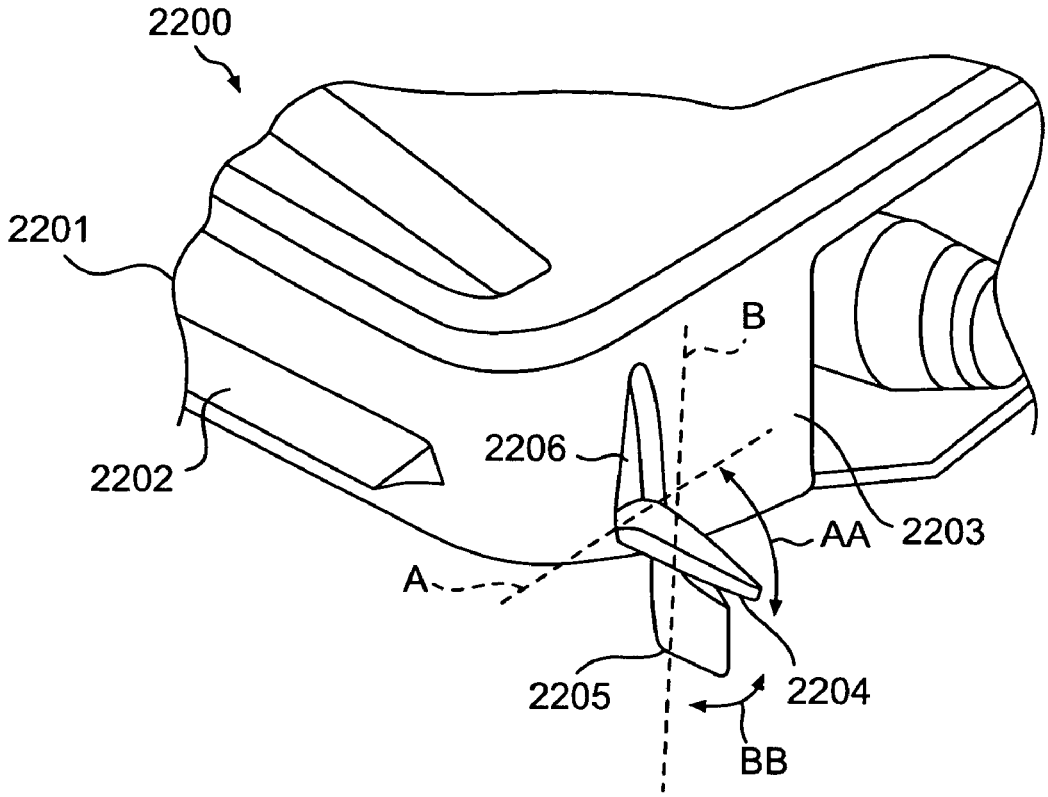
FIGS. 42–44 are schematic partial rear perspective views of a watercraft including a watercraft control mechanism according to another exemplary embodiment of the invention.
Figure 43:
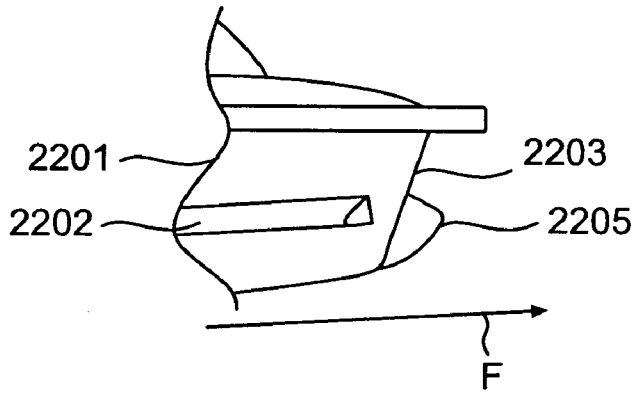
Figure 44:
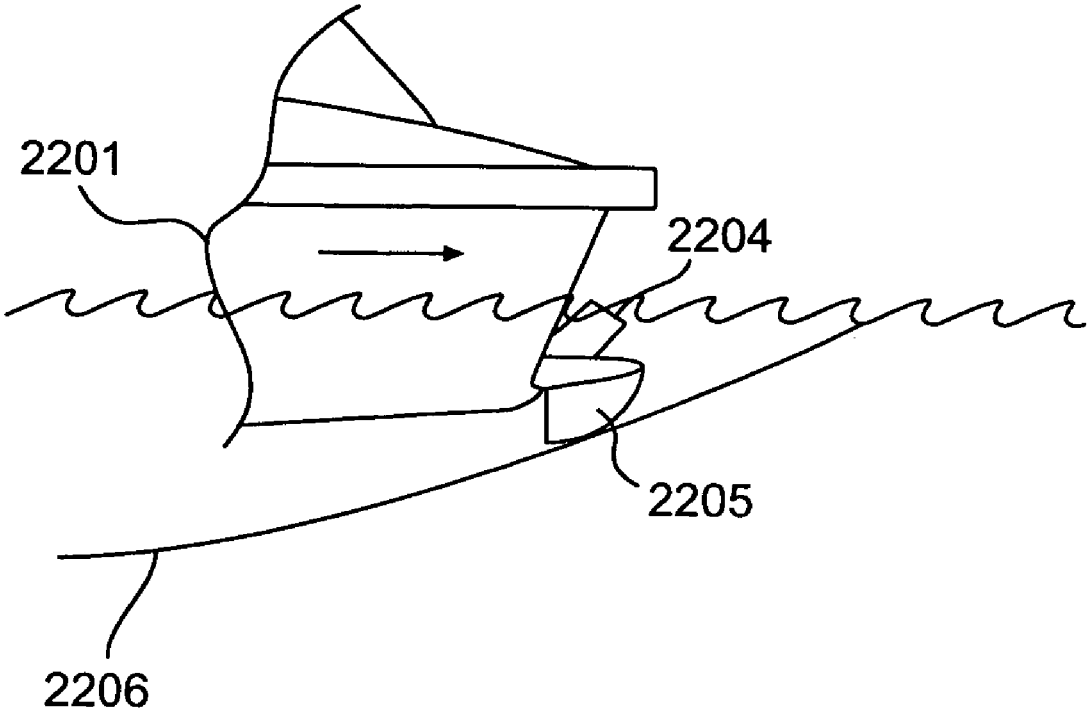

Referring to FIGS. 42–44, a watercraft 2200 includes a hull 2201. Sponsons 2202 (only one being shown in FIG. 42) are attached to the hull 2201 at rear portions thereof. A rudder or vane 2205 is pivotably attached to a transom 2203 of the watercraft 2200 by a vane support 2204. The vane support 2204 is pivotably attached to the transom 2203 about a horizontal axis A and is pivotable as shown by arrow AA. The vane 2205 is pivotably attached to the vane support 2204 about an axis B that is perpendicular to the vane support 2204 and is pivotable as shown by arrow BB to provide steering control to the watercraft 2200. As the watercraft 2200 accelerates, the vane support 2204 pivots toward a recess 2206 in the transom 2203 as water pressure from waterflow F builds up. With the vane support 2204 fully pivoted into the recess 220 6 in the transom 2203, as shown in FIG. 43, the vane 2205 does not contact the waterflow F (as shown in FIG. 43) and does not affect the steering and handling characteristics of the watercraft 2200. Upon deceleration of the watercraft 2200 and decreasing water pressure from the waterflow F, the vane support 2204 and the vane support 2204 and the vane 2205 begin to pivot into the waterflow F to provide steering control to the watercraft 2200. When the vane 2205 is in the down position, as shown in FIG. 44, if the watercraft 2200 contacts the bottom 2206 of the body of water the impact with the bottom 2206 will force the vane support 2204 to pivot upwards into the transom 2203 preventing damage to the vane 2205.

All of the control mechanisms disclosed herein may be linked to the steering mechanism of the watercraft, or to a mechanical link or sensor that actuates the control mechanism.

Although the invention has been described in detail with reference to the exemplary embodiments outlined above, it should be understood that various modifications may be within the level of skill in the art without departing from the spirit and scope of the invention.

What is claimed is:

1. A watercraft comprising:

a hull including a transom;

a steering mechanism disposed on the watercraft;

a water jet propulsion unit disposed on the hull and including a movable steering nozzle operatively connected to the steering mechanism for directing a water jet produced by the unit for steering the watercraft;

a steering vane support pivotably mounted on the transom spaced apart from the water jet propulsion unit and pivotable about a substantially horizontal axis between a steering-vane-operative position and a steering-vane-inoperative position;

a steering vane pivotably supported on the steering vane support and pivotable about a substantially vertical axis and operatively connected to the steering mechanism.

2. A watercraft comprising:

a hull including a transom;

a steering mechanism disposed on the watercraft;

a water jet propulsion unit disposed on the hull and including a movable steering nozzle operatively connected to the steering mechanism for directing a water jet produced by the unit for steering the watercraft;

a first steering vane support pivotably mounted on the transom spaced apart from and to the port side of the water jet propulsion unit and pivotable about a substantially horizontal axis between a first steering-vane-operative position and a first steering-vane-inoperative position;

a first steering vane pivotably supported on the first steering vane support and pivotable about a substantially vertical axis and operatively connected to the steering mechanism;

a second steering vane support pivotably mounted on the transom spaced apart from and to the port side of the water jet propulsion unit and pivotable about a substantially horizontal axis between a second steering-vane-operative position and a second steering-vane-inoperative position;

a second steering vane pivotably supported on the first steering vane support and pivotable about a substantially vertical axis and operatively connected to the steering mechanism.

3. A watercraft comprising:

a hull including a transom;

a steering mechanism disposed on the watercraft;

a water jet propulsion unit disposed on the hull and including a movable steering nozzle operatively connected to the steering mechanism for directing a water jet produced by the unit for steering the watercraft;

a first steering vane support pivotably mounted on the transom spaced apart from and to the port side of the water jet propulsion unit and pivotable about a substantially horizontal axis between a first steering-vane-operative position and a first steering-vane-inoperative position;

a first steering vane pivotably supported on the first steering vane support and pivotable about a substantially vertical axis and operatively connected to the steering mechanism;

a second steering vane support pivotably mounted on the transom spaced apart from and to the port side of the water jet propulsion unit and pivotable about a substantially horizontal axis between a second steering-vane-operative position and a second steering-vane-inoperative position; and a second steering vane pivotably supported on the first steering vane support and pivotable about a substantially vertical axis and operatively connected to the steering mechanism;

the steering vane supports pivoting between their steering-vane-inoperative positions and their steering-vane-operative positions in response to changes in water pressure of water flowing past the hull.

* * * * *